United States Patent [19]

Gronbach et al.

[11] 4,236,272

[45] Dec. 2, 1980

[54] HINGE COMPRISING A COMPRESSION SPRING, WHICH IS ADAPTED TO BALANCE THE WEIGHT OF A HINGED LEAF

[76] Inventors: Wilhelm Gronbach, Dr. Fritz-Huber-Str.73, 8090 Wasserburg/Inn; Alfons Gnann, Max Redelstein-Str.30, 7955 Ochsenhausen, both of Fed. Rep. of Germany

[21] Appl. No.: 927,925

[22] Filed: Jul. 25, 1978

[30] Foreign Application Priority Data

Jul. 27, 1977 [DE] Fed. Rep. of Germany ..... 2733927

[51] Int. Cl.[3] ..... E05D 11/08; E05D 11/10

[52] U.S. Cl. ..... 16/142; 16/144; 16/145; 16/163; 16/167; 16/190

[58] Field of Search ..... 16/163, 167, 190, 145, 16/144, 142, 139, 50

[56] References Cited

U.S. PATENT DOCUMENTS

| | | | |
|---|---|---|---|
| 3,001,225 | 9/1961 | Squire | 16/190 X |
| 3,204,287 | 9/1965 | Gronbach | 16/163 |
| 3,363,281 | 1/1968 | Borsani | 16/163 |
| 3,548,445 | 12/1970 | Dehar | 16/163 X |
| 4,075,735 | 2/1978 | Rock et al. | 16/163 X |

*Primary Examiner*—H. Hampton Hunter
*Attorney, Agent, or Firm*—Fleit & Jacobson

[57] ABSTRACT

The hinge comprises a compression spring, which is adapted to balance the weight of a hinged leaf, such as a flap, lid or door. The compression spring is prestressed and bears at one end on the stationary hinge member and at the other end acts by means of a spring guide on a second hinge member, which is attached to the hinged leaf. The spring guide is supported at one end by two limbs of the stationary hinge member and at the other end by a slidable pin, which is mounted in cam slots, which are respectively provided in the limbs of the stationary hinge member and in a control lever. The latter is pivoted at its other end to the movable hinge member. The cam slots have such a configuration that the excursion of the spring resulting from the pivotal movement of the control lever is minimized.

5 Claims, 4 Drawing Figures

HINGE COMPRISING A COMPRESSION SPRING, WHICH IS ADAPTED TO BALANCE THE WEIGHT OF A HINGED LEAF

This invention relates to a hinge comprising a compression spring, which is adapted to balance the weight of a hinged leaf, such as a flap, lid or door, and generally to oppose a torque exerted on such leaf, which compression spring is prestressed and bears at one end on a stationary hinge memnber and at the other end acts by means of a spring guide on a second hinge member, which is attached to the hinged leaf.

Printed German Application No. 15 84 091 discloses such a hinge in which the compression spring is supported by a spring-guiding rod and attached to the free end thereof, and the free end is pivotally connected by the spring-guiding rod to a roller pivot, the rollers of which are slidably mounted in respective longitudinal guide slots of the stationary hinge member. On that side which faces the roller pivot, the hinge member which is attached to the hinge leaf has an extension, which is provided with a control cam and with a re-stressing cam and a control cam, and during a pivotal movement of the cover the control cam slides on the roller pivot whereas the re-stressing cam engages the roller pivot from behind when the hinged leaf has moved beyond a neutral position to its closed position.

It is an object of the invention to provide a hinge which is adaped to oppose torques exerted by or on leaves which are hinged on a horizontal or vertical axis and to balance a leaf which is hinged on a horizontal axis when said leaf is in a predetermined open position.

In a hinge of the kind described first hereinbefore, this object is accomplished according to the invention in that the spring guide is supported at one end by two limbs of the stationary hinge member and at the other end by a slidable pin, which is mounted in cam slots, which are respectively provided in the limbs of the stationary hinge member and in a control lever which is pivoted at its other end to the movable hinge member, and that the cam slots have such a configuration that the excursion of the spring resulting from the pivotal movement of the control lever is minimized. The hinge according to the invention is much simplier in structure than the known hinge described hereinbefore and for this reason can be manufactured with much smaller overall dimensions and used in additional fields. The hinge may be designed as a three-pivot hinge or as a four-pivot hinge.

Figure 1:
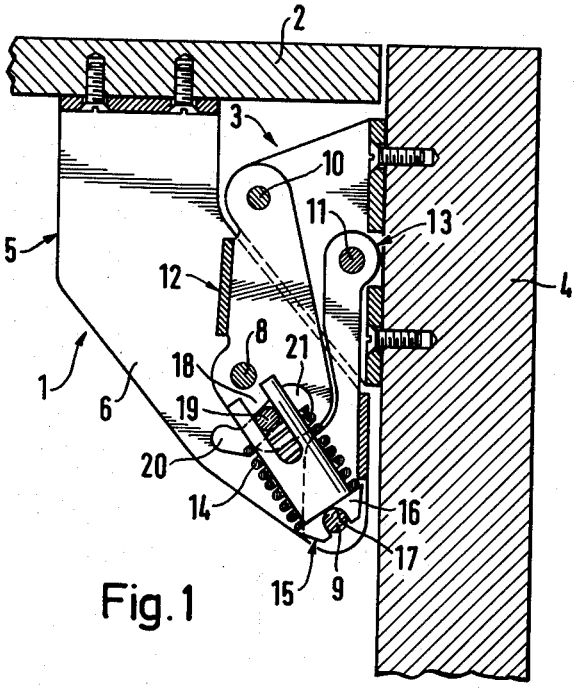
Figure 2:
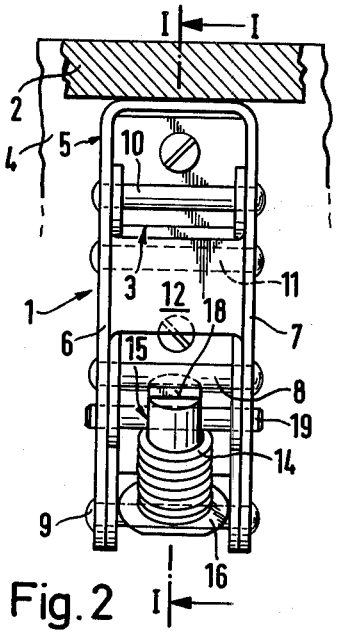
Figure 3:
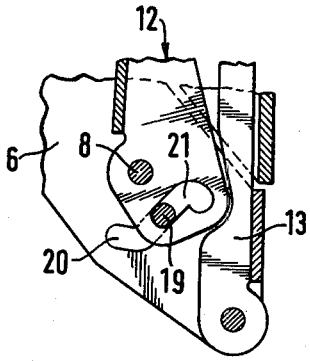
Figure 4:
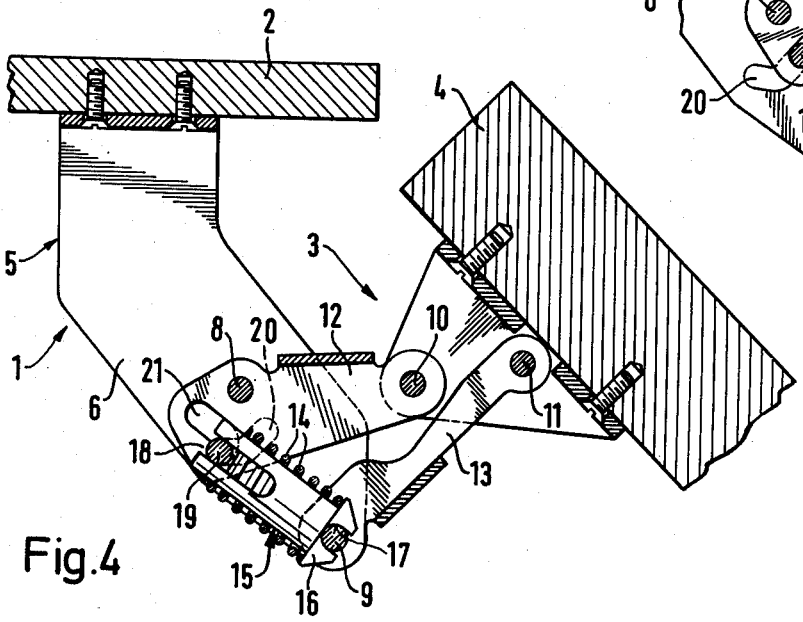

An embodiment of the invention will be described by way of example with reference to the drawing, in which FIG. 1 shows the hinge according to the invention which is installed in an appliance and in its closed position, FIG. 2 is an elevation showing the hinge of FIG. 1 which has been turned through 90° out of the plane of the drawing, FIG. 3 is a fragmentary view showing the hinge of FIG. 1 without the spring and spring guide so that the cam slots are exposed, and FIG. 4 shows the hinge according to the invention in an open position.

The hinge comprises a stationary hinge member 1, which is secured to a housing 2 of an appliance, and a moveable hinge member 3, which is secured to a leaf 4, which is hinged on a horizontal or vertical axis. The hinged leaf 4 may consist of a flap, cover, door or the like. As is apparent from FIG. 2, the stationary hinge member 1 of the embodiment shown by way of example consists of a housing 5, which has the shape of an inverted channel and comprises two laterally disposed, parallel limbs 6, 7. The embodiment shown by way of example constitutes a four-pivot hinge, in which the two hinge members 1, 3 are interconnected by a control lever 12 and a constraining lever 13 by means of four rivet pins 8, 9, 10, 11. The hinge is also provided with a compression spring 14 and a spring guide 15.

The spring guide 15 consists of a rod, which is provided with a flangelike footplate 16. The latter is formed on its underside with a groove 17, in which the spring guide 15 bears on the rivet pin 9, which is mounted at the free end of the limbs 6, 7 of the housing of the stationary hinge member 1. At its head end, which is opposite to the foot plate 16, the spring guide is formed with a recess 18, in which the spring guide 15 bars on a sliding pin 19. The latter is mounted in and guided by cam slots 20 and 21. The cam slot 20 is formed in the limbs 6, 7 of the housing 5 of the stationary hinge member 1. The cam slot 21 is formed in the control lever 12. As is apparent from FIG. 3 showing the closed position and from FIG. 4 showing the open position, the sliding pin 19 is held in either position between stops formed by those ends of the cam slots 20, 21 which are adjacent to each other in the respective position. Cam slots 20, 21 having the configuration shown in FIG. 3 ensure that the excursion of the spring resulting from a pivotal movement of the control lever 12 is minimized.

It is apparent from FIG. 2 that the width of the foot plate 16 is selected so that the limbs of the constraining lever 13 prevent a lateral movement of the spring guide 15. The sliding pin 19 is also held against a lateral movement in that the spring guide 15 engages a recess of the sliding pin adjacent to the recess 18 at the head end of the spring guide.

What I claim is:

1. A hinge for balancing the weight of a hinged leaf, such as a flap, lid or door, and for opposing a torque exerted on such leaf, said hinge comprising:

a stationary member having two limbs;

a moveable hinge member connected to the hinged leaf;

a control lever having a first portion pivotally connected to said stationary member and a second portion pivotally connected to said movable hinge member;

a first cam slot formed in said stationary member;

a second cam slot formed in said control lever and having a portion thereof overlapping said first cam slot during movement of said control lever;

a slidable pin mounted for movement in said cam slots;

spring means for balancing the weight of the hinged leaf comprisng a prestressed compression spring and a spring guide for said compression spring, said compression spring having one end bearing on said stationary member and one end bearing on said slidable pin, said spring guide having one end supported by said limbs of said stationary member and one end supported by said slidable pin; said first cam slot being shaped to control the force exerted by said compression spring, through said slidable pin and said control lever, on said movable hinge member.

2. A hinge according to claim 1, wherein said first and second cam slots are shaped to maintain the spring force at a relatively constant value during movment of said slidable pin in said slots.

3. A hinge according to claim 1, wherein said first and said second cam slots have stops formed in ends thereof which are adjacent to each other in respective end positions, the slidable pin in closed and open positions of the hinge being held between said stops.

4. A hinge according to one of claims 1, 2, or 3, further comprising a housing for said stationary member, and a constraining lever connected by rivet pins to said housing and to said movable hinge member.

5. A hinge according to one of claims 1, 2, or 3, further comprising a rivet pin affixed to said stationary member, and wherein said spring guide comprises a rod having a flangelike foot plate with a groove formed on its underside, the groove bearing on said rivet pin so that said spring guide is held against lateral movement, the spring guide having a head end with a recess formed therein for receiving said slidable pin, said slidable pin being formed with a recess engaged by said spring guide for holding said slidable pin against lateral movement.

* * * * *